US005947090A

United States Patent [19]

Maeda

[11] Patent Number: 5,947,090

[45] Date of Patent: Sep. 7, 1999

[54] FUEL INJECTION VALVE CONTROLLER APPARATUS

[75] Inventor: Susumu Maeda, Saitama, Japan

[73] Assignee: Honda Giken Kogyo Kabushiki Kaisha, Tokyo, Japan

[21] Appl. No.: 09/003,144

[22] Filed: Jan. 6, 1998

[30] Foreign Application Priority Data

Feb. 14, 1997 [JP] Japan ..... 9-047158

[51] Int. Cl.[6] ..... F02D 41/20

[52] U.S. Cl. ..... 123/490; 123/527; 361/154

[58] Field of Search ..... 123/527, 490; 361/154

[56] References Cited

U.S. PATENT DOCUMENTS

| | | | |
|---|---|---|---|
| 3,982,505 | 9/1976 | Rivere | 123/490 |
| 4,511,945 | 4/1985 | Nielsen | 123/490 |
| 5,053,911 | 10/1991 | Kopec et al. | 123/490 |
| 5,531,198 | 7/1996 | Matsuura | 123/490 |
| 5,632,250 | 5/1997 | Kato et al. | 123/490 |

FOREIGN PATENT DOCUMENTS

| | | |
|---|---|---|
| 58-211538 | 12/1983 | Japan . |
| 62-4543 | 1/1987 | Japan . |

*Primary Examiner*—Erick R. Solis

*Attorney, Agent, or Firm*—Nikaido, Marmelstein, Murray & Oram LLP

[57] ABSTRACT

A second operation mode without a hold period is used for starting up an engine when the ambient temperature is extremely low so that an electromagnetic coil remains fed with the current until the valve opening is completed, thus ensuring elimination of an injection valve cling up. A full opening of the injection valve is recognized by detecting a decrease of a coil current in the electromagnetic coil. The lower the temperature where the cling up is hardly eliminated in a short period, the longer the energizing period for the coil is provided. Consequently, such an event as failing to eliminate the cling up due to too short of the energizing period will be prevented.

8 Claims, 8 Drawing Sheets

FUEL INJECTION VALVE CONTROLLER APPARATUS

BACKGROUND OF THE INVENTION

1. Field of the Invention

The present invention relates to a fuel injection valve controller apparatus for use in a gaseous fuel internal combustion engine and particularly, to a fuel injection valve controller apparatus suited for improving the starting performance of the engine at a lower temperature.

2. Description of the Invention

FIG. 10 is a longitudinal cross sectional view showing a conventional electromagnetic fuel injection valve (referred to as an "injection valve" hereinafter). A hollow sleeve 2 made of a magnetic material is fitted into a cylindrical housing 1 made of a similar magnetic material. The hollow sleeve 2 includes a stationary core 2*a,* a flange 2*b,* and a fuel inlet member 2*c.* An electromagnetic coil 4 (referred to as a "coil" hereinafter) is wound on a bobbin 3 and disposed in a space between the housing 1 and the stationary core 2*a* so that it surrounds the stationary core 2*a.* The stationary core 2*a* has a compression coil spring 5 therein for urging a plunger (movable core) 6, which is located opposite to one end of the hollow sleeve 2, in a direction to close the injection valve.

A valve seat 8 is provided in the tip of the housing 1, which slidably accommodates a needle valve 7 coupled to the movable core 6. The valve seat 8 is covered with a nozzle 9 and swagelocked together with the nozzle 9 to one (front) opening end of the housing 1. The flange 2*b* of the hollow sleeve 2 is also swagelocked to the other or rear opening end of the housing 1. The flange 2*b* is fixedly joined at top with a connector 10 made of an insulating material such as resin. The connector 10 has a terminal 10*a* therein electrically connected to the coil 4. The fuel inlet member 2*c* of the hollow sleeve 2 accommodates a strainer 12 which includes a filter net 11 therein. A fuel is admitted through the hollow sleeve 2 and flown to a space between the valve seat 8 and the needle valve 7.

In operation, energizing of the coil 4 through the terminal 10*a* causes the movable core 6 to be attracted toward the hollow sleeve 2 and the needle valve 7 to depart from the valve seat 8 as resisting against the yielding force of the compression coil spring 5. Accordingly, the fuel is ejected out from an injection aperture 13 provided in the front end of the valve seat 8. The energizing of the coil 4 or the injection of the fuel can be controlled depending on an operating condition of the engine.

For improving the response of the injection valve to the operating condition of the engine or making the injection valve compatible with injection of a large amount of fuel such as in a direct injection engine or a gaseous fuel internal combustion engine, it is essential to supply the coil 4 with a large quantity of electric current and thus increase the magnetic attraction of the stationary core 2*a* for valve opening. However, if such a higher current were fed throughout the energizing period, the temperature of the coil 4 may radically increase and extra scheme for radiating heat from relevant switching elements (or drivers) in a drive circuit for energizing the coil 4 will be needed and it will be rather difficult to realize in the industrial field.

For a countermeasure thereof, the coil current is provided of a higher intensity at the starting of valve opening and it is reduced to the revel of maintaining the valve opening after completion of the valve opening (when the needle valve has been lifted up). It is known that the coil current in the injection valve is varied depending on a change (increase) of the inductance due to amount of the movable core, that is, the coil current decreases as the needle valve is fully lifted up (as for example disclosed in Japanese Patent Publication No. SHO 62-4543). For example, a controller apparatus disclosed in Japanese Patent Laid-open Publication No. SHO 58-211538 provides detecting the completion of valve opening from a drop of the coil current corresponding to the end of lifting operation and then decreasing the coil current.

Fuel for automobile engines is commonly gasoline which, in some cases, is now replaced by gaseous fuel such as natural gas. Natural gas is stored under pressure in a container before used. For feeding the compressed natural gas (CNG) into an engine, such a type of the fuel injection valve for gasoline as described above may be employed.

The major disadvantage in use of the fuel injection valve for feeding compressed natural gas to the engine is as follows. As the natural gas is compressed by a compressor in which oil is applied for lubrication between its piston and cylinder wall, a portion of the oil and drops of water in the atmosphere are very likely to mix in the natural gas. Since only small amounts of the oil and water generally mixes in the fuel gas, they cause no trouble in the engine operation under normal conditions. However, water mixing in the fuel may be frozen at an extremely low temperature or in the winter, hence locking the needle valve to the valve seat or causing "cling up".

FIGS. 8A and 8B illustrate comparison of the valve opening period in the injection valve between without cling-up (FIG. 8A) and with cling-up (FIG. 8B), in which the waveform "a" is a valve opening pulse signal supplied to the coil 4, the waveform "b" is a current through the coil 4, and the waveform "c" is the lifting amount of the needle valve 7. At the time t0, the needle valve 7 starts lifting up and completes its lifting amount at t1 thus fully opening the injection valve. When a predetermined short length of time has elapsed after the full opening, the valve current is reduced to a lower level to maintain the valve opening. At the time t2, the pulse signal "a" is deenergized to start closing the valve. As clearly understood from the diagrams of comparison, the valve when cling up does not immediately responds to the rise of the pulse signal "a" and waits until the valve current is more increased. This causes the valve opening period AA to be shorter than in a normal operation, thus decreasing the injection of the fuel and impairing the performance at start up of the engine.

SUMMARY OF THE INVENTION

It is an object of the present invention to provide a fuel injection valve controller apparatus capable of providing the start-up performance of the engine with high uniformity regardless of cling up of the needle valve.

According to the present invention, a fuel injection valve controller apparatus for driving a fuel injection valve for a gaseous fuel internal combustion engine which is opened by feeding an electromagnetic coil with a current comprises temperature detecting means for detecting the temperature representative of an engine temperature, valve opening signal generating means for producing a valve opening signal which defines a period for opening the fuel injection valve, driver controlling means adapted to be operable in one of a first operation mode having a hold period for holding the full opening of the fuel injection valve and a second operation mode not having the hold period and driver controlling means being the arranged in the first operation mode for decreasing the coil current after the fuel injection valve has fully been opened with a high intensity of the coil current fed to the electromagnetic coil in response to the valve opening signal and during the valve opening signal is enabled, and switching means for, when the detected engine temperature is lower than a predetermined temperature, switching the driver controlling means to the second operation mode for at least first cycle of the valve opening operation after turning on of an ignition switch for starting up the engine.

According to the present invention, the operation mode without the hold period is used for starting up when the ambient temperature is extremely low so that the electromagnetic coil remains fed with the current until the valve opening is completed, thus ensuring elimination of the cling up. The full opening of the fuel injection valve is recognized by detecting a decrease of the coil current fed to the electromagnetic coil. The lower the temperature where the cling up is hardly eliminated in a short period, the longer the energizing period for the coil is provided. Consequently, such an event as failing to eliminate the cling up due to too short of the energizing period will be prevented.

DETAILED DESCRIPTION OF THE PREFERRED EMBODIMENT

Figure 7:
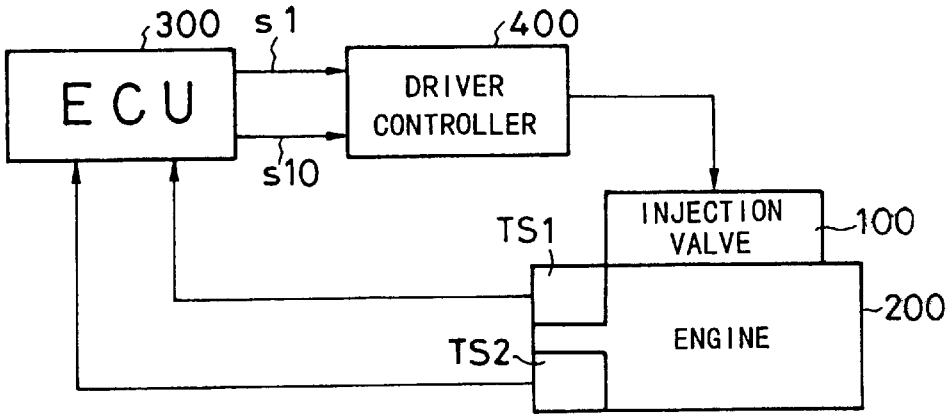
FIG. 7 is a block diagram showing a primary part of an engine controller system which includes the fuel injection valve controller apparatus of the embodiment of the present invention.
Figure 10:
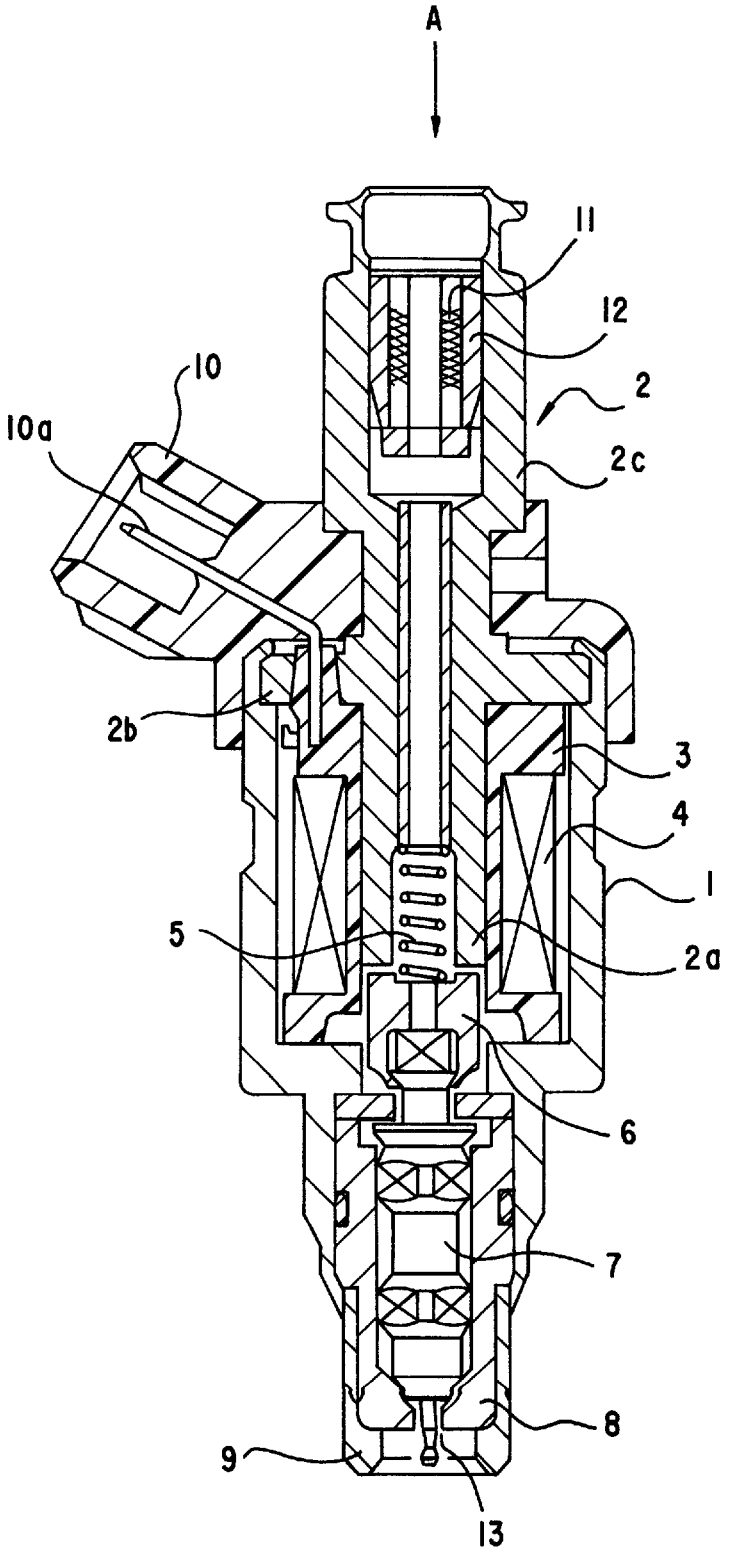
FIG.10 PRIOR ART
FIG. 10 is a cross sectional view of a typical fuel injection valve.

The present invention will be described in more details referring to the accompanying drawings. FIG. 7 is a block diagram showing a primary part of an engine controller system which includes a fuel injection valve controller apparatus according to the embodiment of the present invention. It is assumed that controller is equipped with the fuel injection valve shown in FIG. 10 and the following description refers to also FIG. 10. As shown in FIG. 7, the fuel injection valve 100 is, for example, mounted to an intake manifold (not shown) in an engine 200. The intake manifold is equipped with an intake air temperature sensor TS1 and a cooling water temperature sensor TS2 is mounted to a water jacket (not shown) for cooling the engine. There is an ECU 300 including a microcomputer and being responsive to the engine condition which is decided based on the detection signals from the intake air temperature sensor TS1, the cooling water temperature sensor TS2, and the other sensors (not shown) for producing and delivering control signals S1 and S10 to a driver controller 400 to control the engine operation.

The control signal S1 has a pulse width to determine the valve opening period required for having an optimum air/fuel ratio suitable to an operation condition of the engine 200. The signal S10 is a control signal for switching the operation mode of the driver controller 400 between the normal starting operation and the starting up in a lower temperature. In the present embodiment, the signal S10 is at high level in the normal operation while it turns to low level only at the initial cycle of the lower temperature start up. The fuel injection valve 100 is thus operated in the mode determined by the level of the signal S10 and energized for the period determined by the signal S1.

Figure 1:
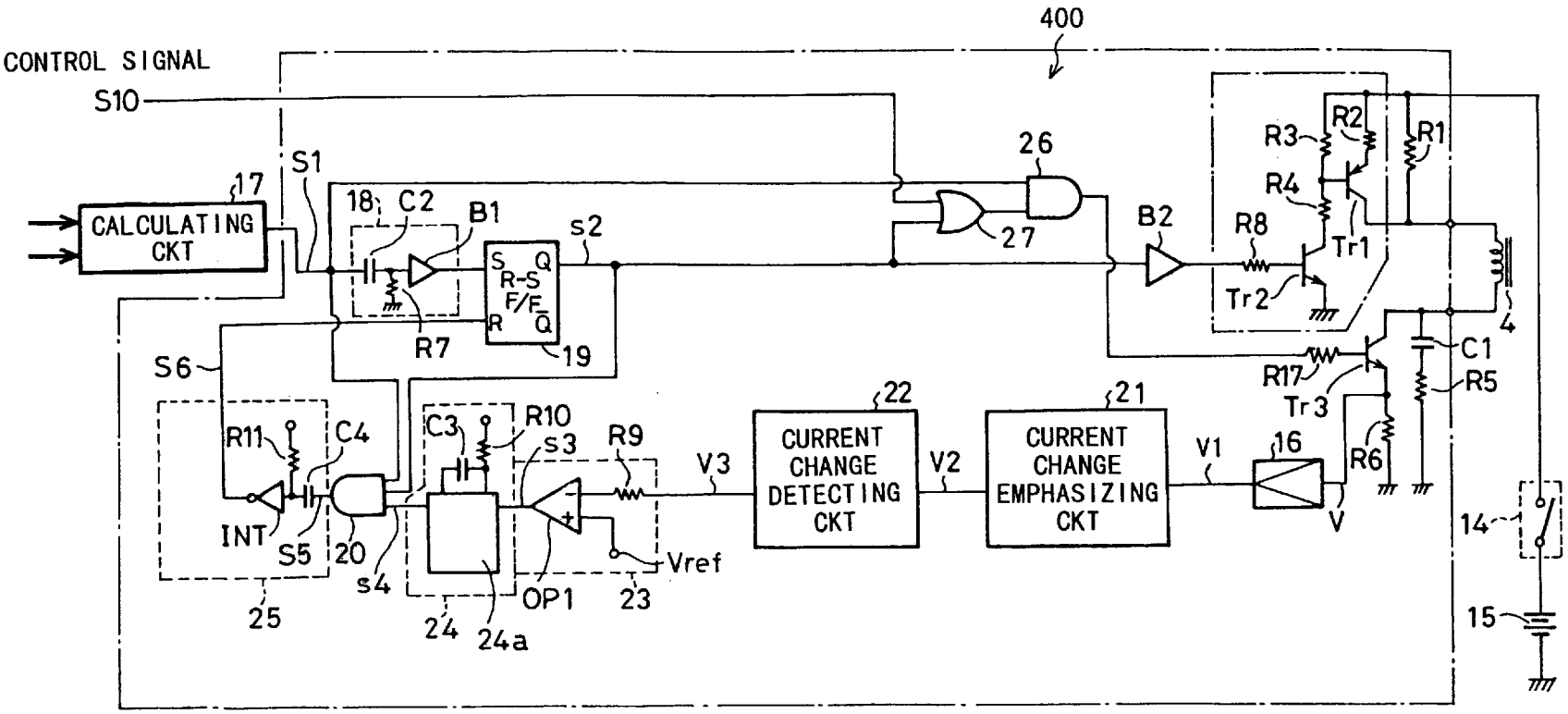
FIG. 1 is a circuit diagram of a controller apparatus according to an embodiment of the present invention.

The drive controller 400 is now explained in more detail referring to FIG. 1. As shown, a high potential end of the coil 4 for driving the fuel injection valve is connected via a resistor R1 and an ignition switch 14 to the positive terminal of a battery 15. A transistor Tr1 having an emitter resistor R2 is connected in parallel to the resistor R1. The base of the transistor Tr1 is connected to one ends of two resistors R3 and R4 respectively. The other end of the resistor R3 is connected to the resistor R2, while the other end of the resistor R4 is connected to the collector of the transistor Tr2 of which emitter is grounded.

The lower potential end of the coil 4 is connected to the collector of the transistor Tr3. The transistor Tr3 is connected in parallel with a combination of the a capacitor C1 and a resistor R5 coupled in series to each other. The emitter of the transistor Tr3 is connected to a resistor R6 which serves as a current detecting means and delivers a potential signal V indicative of the coil current to the input of an amplifier circuit 16.

The ECU 300 includes a calculating circuit 17 from which the signal S1 having a pulse width corresponding to the valve opening period is released. The output signal S1 is fed to a trigger circuit 18 which comprises a capacitor C2, a resistor R7, and a buffer B1. The output of the trigger circuit 18 is connected to the set terminal of an RS flip-flop 19. The Q output S2 of the flip-flop 19 is connected to the base of the transistor Tr2 via a buffer B2 and a resistor R8 coupled in series to each other. The output signal S1 is also fed to a first and a second AND gates 20 and 26. In addition, the first AND gate 20 receives the Q output S2 from the flip-flop 19.

The output S2 of the flip-flop 19 is further transmitted to an OR gate 27. The output of the OR gate 27 is connected to the second input of the second AND gate 26. The other input of the OR gate 27 is supplied with the control signal S10. The output of the second AND gate 26 is connected via a resistor R17 to the base of the transistor Tr3.

An output voltage V1 from the amplifier circuit 16 is fed to a current change emphasizing circuit 21 from which an output signal V2 is transmitted to a current change detecting circuit 22. Both the current change emphasizing circuit 21 and the current change detecting circuit 22 will be described later in more detail referring to FIG. 2. An output V3 from the current change detecting circuit 22 is fed via a resistor R9 to the negative (inverse) input terminal of an operational amplifier OP1 which defines a comparator circuit 23. The positive (non-inverse) input terminal of the operational amplifier OP1 is supplied with a reference voltage Vref. The current change detecting circuit 22 and the comparator circuit 23 constitute a current change detecting means.

An output signal S3 from the operational amplifier OP1 is fed to a one-shot circuit 24 which comprises a capacitor C3, a resistor R10, and a one-shot multivibrator 24*a*. An output signal S4 from the one-shot circuit 24 is transmitted as one input to the first AND gate 20. The one-shot multivibrator 24*a* may preferably be of non-retriggerable type such as uPD74HC123A. An output signal S5 from the first AND gate 20 is fed to a trigger circuit 25 which comprises a capacitor C4, a resistor R11, and an inverter circuit INT. An output signal S6 from the trigger circuit 25 is transmitted to the reset terminal of the flip-flop 19.

Figure 2:
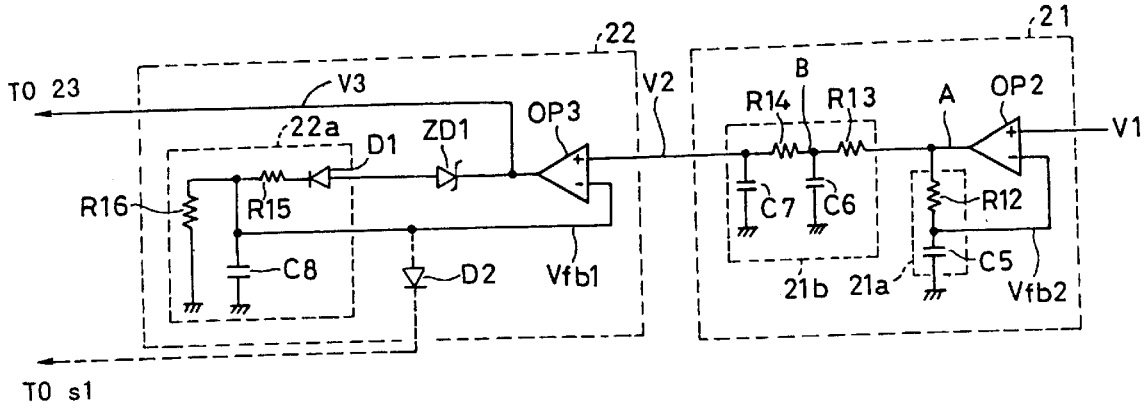
FIG. 2 is a circuit diagram showing a section of the controller apparatus of the embodiment of the present invention.

Referring to FIG. 2, the current change emphasizing circuit 21 and the current change detecting circuit 22 are now explained. The current change emphasizing circuit 21 has at its first stage an operational amplifier OP2 of which positive terminal is supplied with the output signal V1 from the amplifier circuit 16. The negative terminal of the operational amplifier OP2 receives a delayed negative feedback signal Vfb2 from a negative feedback delay circuit 21*a* which comprises a resistor R12 and a capacitor C5. An output A from the operational amplifier OP2 is fed to a two-stage filter 21*b* which comprises a resistor R13 (2.2 kiloohm), a resistor R14 (47 kiloohm), a capacitor C6 (0.1 microfarad), and a capacitor C7 (4700 picofarads).

An output signal V2 from the filter 21*b* is fed to the positive terminal of an operational amplifier OP3 located at the first stage of the current change detecting circuit 22. The negative terminal of the operational amplifier OP3 is supplied with a delayed negative feedback signal Vfb1 from a negative feedback delay circuit 22*a* which comprises a diode D1, resistors R15 and R16, and a capacitor C8. An output signal V3 from the operational amplifier OP3 is fed via a Zener diode ZD1 to the anode of the diode D1. The Zener diode ZD1 is a potential difference generating means for making the negative feedback delay circuit 22*a* stable with the output of the operational amplifier OP3. The Zener diode ZD1 preferably has a breakdown voltage higher than an offset voltage of the operational amplifier OP3 and more particularly, its breakdown voltage may be substantially 1 to 4 volts in relation to 12 volts of a source voltage from the battery 15. It should be noted that the Zener diode ZD1 can be eliminated since the negative feedback delay circuit 22*a* is stabilized in operation with a potential difference produced by forward voltage drop across the diode D1.

The charge time constant is determined by the resistor R15 and the capacitor C8 so that it is small enough to follow a possible positive change of the potentials V1 and V2. While, the discharge time constant is determined by the resistor R16 and the capacitor C8 so that it is greater than a possible rate in the negative change of the potentials V1 and V2. For example, to have the charge time constant of 0.022 millisecond and the discharge time constant of 2.2 milliseconds, the resistor R15, the resistor R16, and the capacitor C8 are set to 1 kiloohm, 100 kiloohms, and 0.022 microfarad, respectively.

The output V3 of the operational amplifier OP3 is connected to a comparator circuit 23 (FIG. 1). For promoting the discharge of the capacitor C8, a diode D2 may be provided connecting the delay output of the negative feedback delay circuit 22*a* to the output line of the calculating circuit 17 as denoted by the dotted line in FIG. 2.

Figure 3:
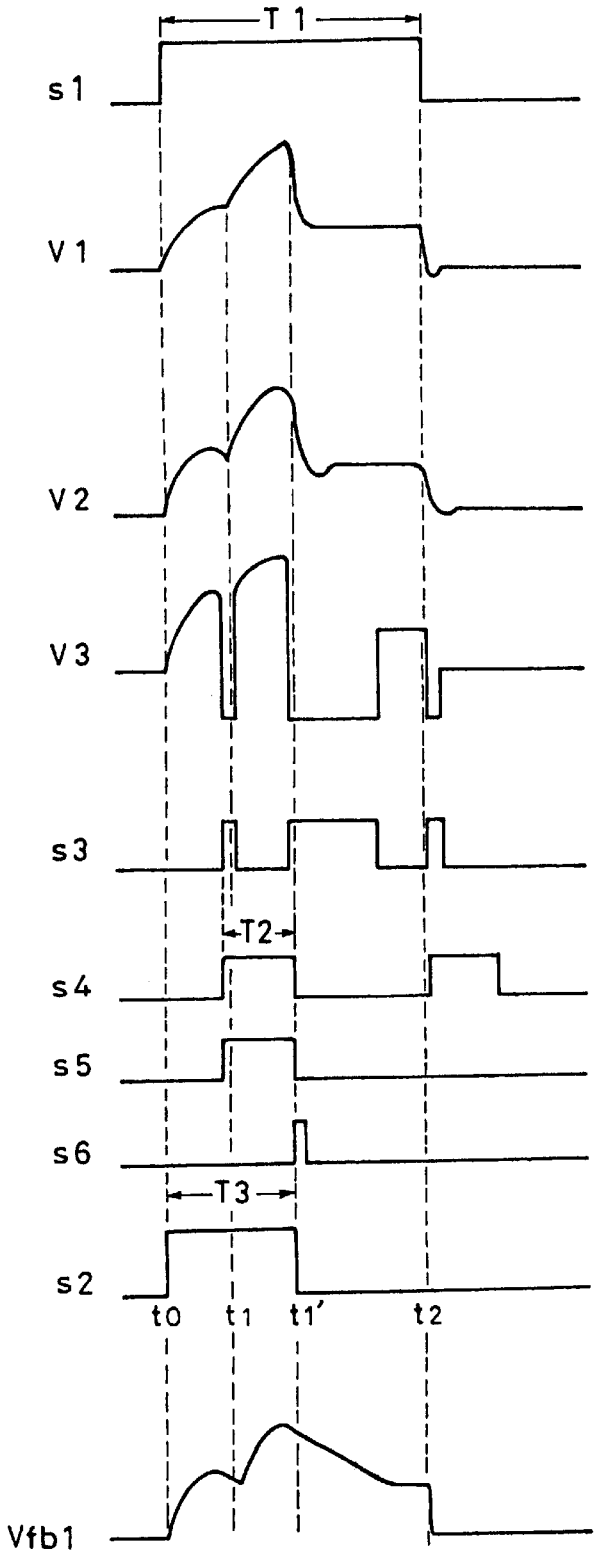
FIG. 3 is a waveform diagram showing operation of the controller apparatus.

The operation of the circuits shown in FIGS. 1 and 2 is now explained referring to the waveform diagram of FIG. 3. The explanation will start with an operation in the normal mode with the control signal S10 being high. When the ignition switch 14 is turned on, the voltage (e.g. 12 volts) is applied from the battery 15 to the driver controller 400 (FIG. 1). In general, the ignition switch for a vehicle internal combustion engine has four contacts; LOCK (shutting off all power supply), ACC (turning on a vehicle radio, etc), ON (running the vehicle), and START (energizing a starter motor) arranged in this order. It should be noted in the present specification that when the ignition switch is turned on, it stays at either ON or START contact. When the calculating circuit 17 releases the valve opening pulse signal S1 at the time t0, the second AND gate 26 is opened with the OR gate 27 having been opened by the control signal S10 and then the transistor Tr3 is activated. The pulse signal S1 is kept high during the valve opening period T1 determined by the calculating circuit 17. Simultaneously, the trigger circuit 18 in response to the signal S1 causes the flip-flop 19 to be set. The rise of the Q output S2 of the flip-flop 19 turns on the transistors Tr2 and Tr1 allowing a high intensity of current to run via the two resistors R1 and R2 connected in parallel, the transistor Tr3, and the resistor R6 to the coil 4.

The current fed to the coil 4 is detected in term of a potential drop V across the resistor R6 or the output voltage V1 of the amplifier circuit 16. When the coil 4 is energized at t0, its current increases to elevate the potential V1 as shown in FIG. 3. This causes the movable core 6 to be attracted by the stationary core 2*a* increasing the inductance of the coil 4 and thus temporarily lowering the coil current and the potential V1. As the needle valve 7 is attracted to the extream end of its stroke, the potential V1 soars again at t1. The temporarily lowering of the potential V1 means the approaching of the needle valve 7 to its stroke end. After a given period T2 required for ensuring soft stopping of the needle valve 7 has elapsed since the lowering of the potential V1 is detected, the operation is switched (at the time t1') to a hold period where the coil 4 is supplied with a low intensity of current for holding the valve opening. The switching to the low or hold current is carried out by the following procedure.

The current change emphasizing circuit 21 shapes up the waveform of the potential V1 to produce the potential V2 in which a change thereof is emphasized, as described later in more detail. The potential V2 is fed to the positive input of the operational amplifier OP3 in the current change detecting circuit 22. Since the charge time constant of the resistor R15 and the capacitor C8 are low, the delayed negative feedback signal Vfb1 of the operational amplifier OP3 is substantially equal to the potential V2 at the positive input during the change emphasized potential V2 is increasing. The operational amplifier OP3 delivers the output V3 which is higher than a sum (4 volts or more) of the breakdown voltage of the Zener diode ZD1 and the forward voltage drop of the diode D1, while its two inputs are substantially equal to each other in the amplitude level. When the reference voltage Vref of the operational amplifier OP1 in the comparator circuit 23 is set to a half (that is, 2 volts) of the breakdown voltage (4 volts in this embodiment) of the Zener diode ZD1, since the output V3 remains higher than the reference voltage Vref during the potential V1 is increasing, the output S3 of the operational amplifier OP1 stays at low level. Accordingly, the two signals S4 and S5 are kept low hence disabling the trigger circuit 25 to deliver the reset signal S6 and maintaining the high coil current mode.

When the potential V2 begins to be lowered by increase of the inductance of the coil 4 close to the time t1, the delayed negative feedback signal Vfb1 fails to follow the drop of the potential V2 due to the large discharge time constants of the resistor R16 and the capacitor C8 and whereby the potential at the negative terminal of the operational amplifier OP3 becomes higher than the input potential V2 at the positive terminal of the same. This causes the output V3 of the operational amplifier OP3 to drop down to nearly zero volt. When the output V3 is lower than the reference voltage Vref of the comparator circuit 23, the output S3 of the operational amplifier OP1 shifts to high level triggering the one-shot circuit 24 at the following stage. The output S4 of the one-shot circuit 24 is kept on during a period T2 (e.g. 0.4 to 0.5 millisecond) determined by the resistor R10 and the capacitor C3. The period T2 lasts from the lifting amount of the needle valve is finished until the needle valve becomes at rest, or the period T2 is for delaying the current change detecting signal. The signal S4 causes the first AND gate 20 to open and its output S5 to stay high during the period T2. In response to the decay of the output S5, the trigger circuit 25 delivers the signal S6 to the reset input of the flip-flop 19. When the flip-flop 19 is reset by the signal S6 at the time t1', the high coil current period T3 ends up. More specifically, the decay of the signal S2 turns off the transistors Tr1 and Tr2 and disconnects the coil current flowing through the transistor Tr1 thus allowing the low current to flow through the coil 4 for the hold period.

The signal S3 also rises in a transit period (close to the time t1' in FIG. 3) where the operation is switched to the low current mode and the potential V1 decreases. However, because of the non-retriggerable type one-shot multivibrator used in the one-shot circuit 24, the rising of the signal S3 will not affect the output S4.

The current change detecting circuit 22 detects a decrease in the current flowing through the coil 4 based on a legible voltage change of at least 4 volts (the sum of the breakdown voltage in ZD1 and the voltage drop in D1) to 0 volt caused by inverse of the level relation between the input V2 at the positive input of the operational amplifier OP3 and the delayed negative feedback signal Vfb1 at the negative input of the same. This can absorb any variation such as a source voltage change and an offset voltage change caused by temperature drift. The operational amplifier OP3 will neither affected by short pulse such as an ignition noise because it is less responsive to such short pulses. As described above, the current change detecting circuit 22 in the embodiment is capable of reliable detecting a decrease in the current through the coil 4.

Figure 4:
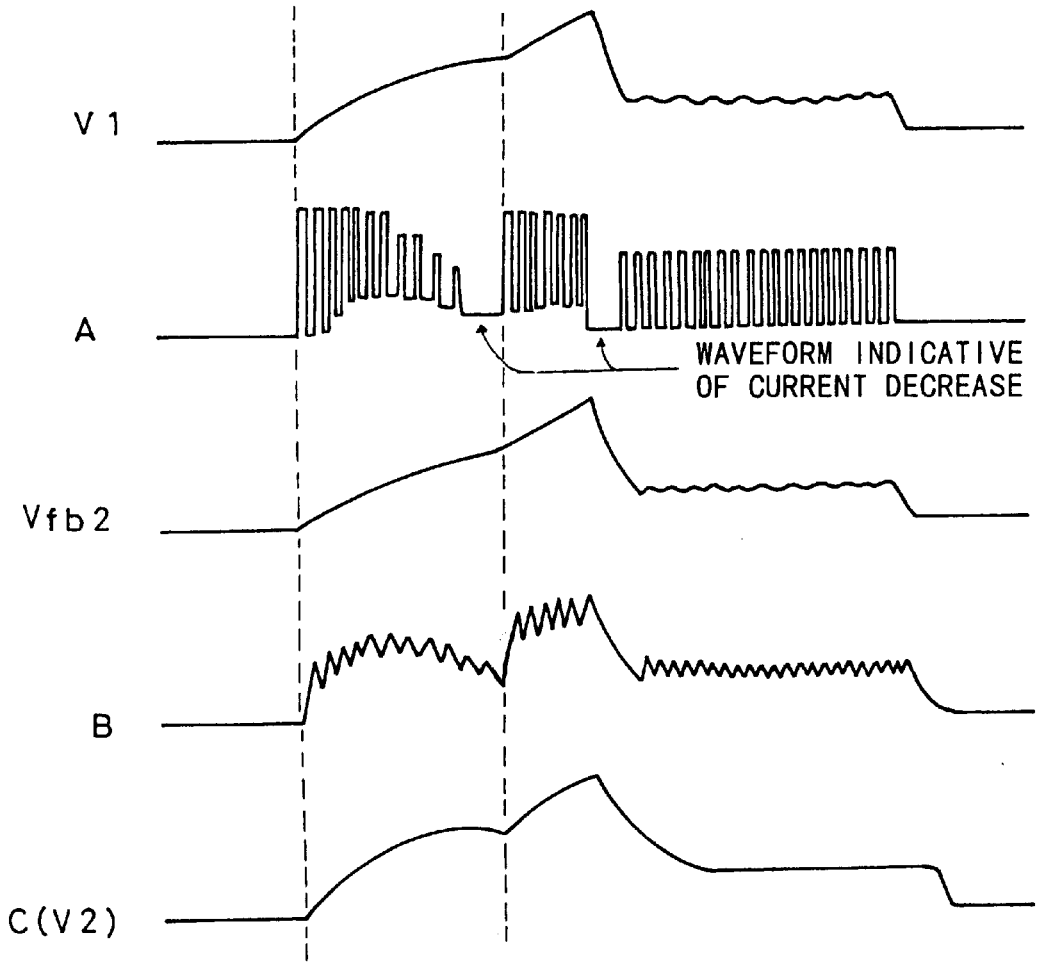
FIG. 4 is a waveform diagram showing operation of a current change emphasizing circuit.

The operation of the current change emphasizing circuit 21 is now explained referring to the waveform diagram of FIG. 4. The output A is controlled by the operational amplifier OP2 so that the potential V1 at its positive input and the delayed negative feedback signal Vfb2 at its negative input are substantially equal to each other. More specifically, when the potential V1 is higher than the delayed negative feedback signal Vfb2, the output A is increased to be higher than the potential V1. When the potential V1 is lower than the delayed negative feedback signal Vfb2, on the contrary, the output A is decreased to be lower than the existing level. Since the delayed negative feedback signal Vfb2 has a delay determined by the time constant of the resistor R12 and the capacitor C5, the operational amplifier OP2 delivers a rather oscillating version of the maximum amplitude (waveform A in FIG. 4).

As the injection valve comes close to its full opening state, the increasing change in the potential V1 or the coil current shifts to decreasing change and the potential V1 at last reaches to be equal to the delayed negative feedback signal Vfb2 which has been delayed by a certain time respective to the potential V1. Upon the potential V1 and the delayed negative feedback signal Vfb2 being equal to each other, the operational amplifier OP2 disables its output. Accordingly, the output A of the operational amplifier OP2 has a waveform indicative of the current decrease which is shown by arrows in FIG. 4.

In brief, the operational amplifier OP2 operates as follows. While the input signal V1 is increasing, the average of the output A is kept higher than the delayed negative feedback signal Vfb2. While the input signal V1 is decreasing, the average of the output A is kept lower than the delayed negative feedback signal Vfb2. By this manner, the delayed negative feedback signal Vfb2 is controlled to follow the input signal V1. Accordingly, the output V2 of a second stage filter is higher than the input V1 when the coil current is increasing while lower when it is decreasing. In addition, when the input signal V1 is stable, the output V2 is converged so that it is equal in amplitude to the input V1.

The output A of the operational amplifier OP2 is then passed to a first stage filter composed of the resistor R13 and the capacitor C6 and the second stage filter composed of the resistor R14 and the capacitor C7 where it is converted to the signal V2 in which the current change is emphasized. Consequently, the decrease of the potential V1 is converted to the emphasized decrease of the potential V2, thus providing ease of the detection in the current change detecting circuit 22. The above is the control of power supply over the current through coil 4 in the first operation mode or normal condition.

For starting in the low temperature condition, the second operation mode is selected with generation of the first valve opening pulse signal by turning on the ignition switch 14, as will be described later in more detail referring to FIG. 6. In the second operation mode, the control signal S10 is turned to low thus providing decrease of the coil current. When the flip-flop 19 is reset at t1' shown in FIG. 3, the two inputs of the OR gate 27 are low thus closing the gate 27 and thus the AND gate 26. This causes the transistor Tr3 to be disconnected thus to stop the energization of the coil 4. More particularly, just after a full opening amount of the fuel injection valve (including the period T2) in a first cycle is completed in the low temperature start-up mode, the coil current is turned to zero and the closing amount starts. As the result, the supply of fuel in the first cycle of the full valve opening of the injection valve can be kept minimum while the cling up of the valve is certainly unfastened.

Figure 5A:
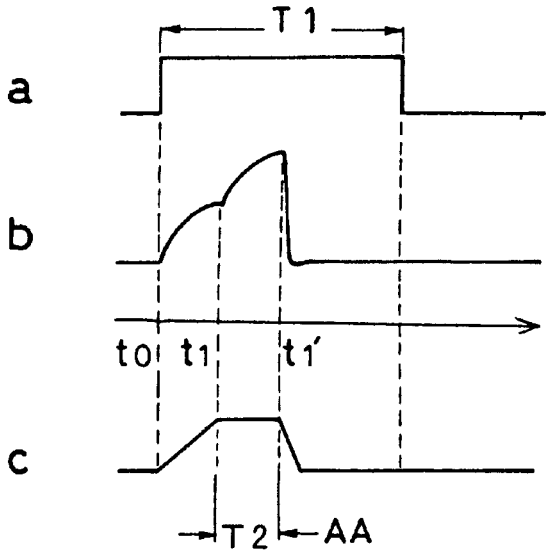
FIGS. 5A and 5B are waveform diagrams showing the full opening period of a valve according to one embodiment of the present invention.
Figure 5B:
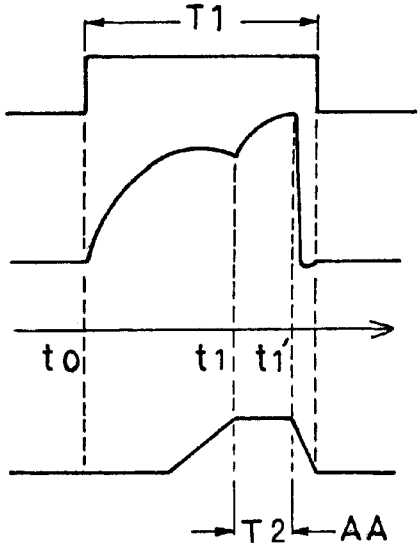
Figure 8A:
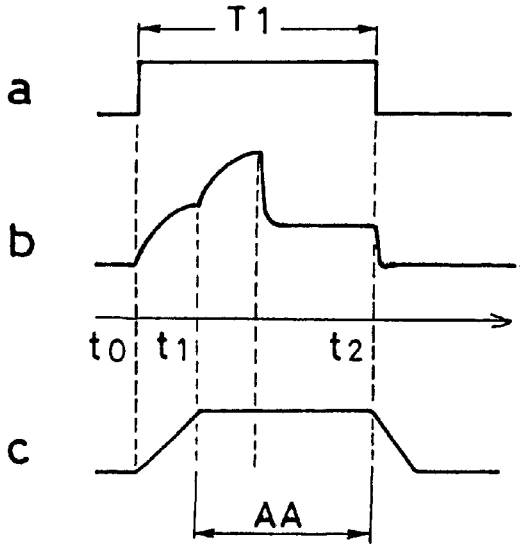
FIG. 8A PRIOR ART
FIGS. 8A and 8B are waveform diagrams showing the valve opening period in a prior art.
Figure 8B:
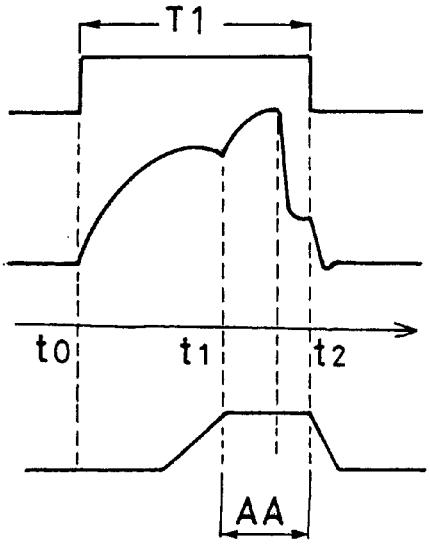
FIG. 8B PRIOR ART

FIGS. 5A and 5B illustrate the full valve opening periods without and with the cling up of the injection valve respectively in the low temperature startup mode, in which the waveforms "a", "b", and "c" are a pulse signal for energizing the coil 4, a current flowing in the coil 4, and a lift amount of the needle valve 7, respectively. Without the cling up, the needle valve 7 starts its lifting amount at t0 and the lifting amount is finished at t1 when the injection valve is fully opened as shown in FIG. 5A. With the cling up, the start of the lifting amount is delayed thus retarding the full opening at t1 as shown in FIG. 5B. In each case, at the time t1' lagged by time T2 from t1 when the valve is detected to be fully opened, the driver operation is disabled and the coil current is disconnected before the closing amount of the valve starts. As clearly understood from the illustrations, the period T2 is virtually equal to the full opening period AA. In this embodiment, immediately after the full opening of the valve has become stable at time t1' with or without the cling up, the closing amount starts without calling for the hold period. Accordingly, the full opening AA of a short period is equal to T2 in both cases.

Figure 1A:
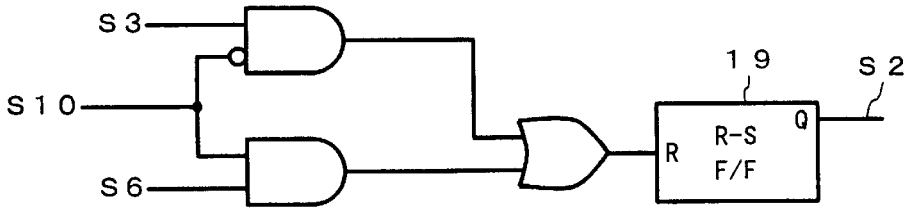
FIG. 1A is a partial circuit diagram showing a modification of the circuit shown in FIG. 1.

A modification of the second operation mode may be provided in which the coil current is shut off to minimize the supply of fuel, without t2, immediately after full opening of the valve (the decrease of the coil current) has been detected at t1. This is implemented by a signal selecting means (FIG. 1A) which can select the output S6 of the trigger circuit 25, shown in FIG. 1, when the control signal S10 is at high level in the normal startup mode, while the output S3 of the comparator circuit 23 when the control signal S10 is at low level in the low temperature startup mode. The flip-flop 19 is then reset using the selected signal.

Figure 6:
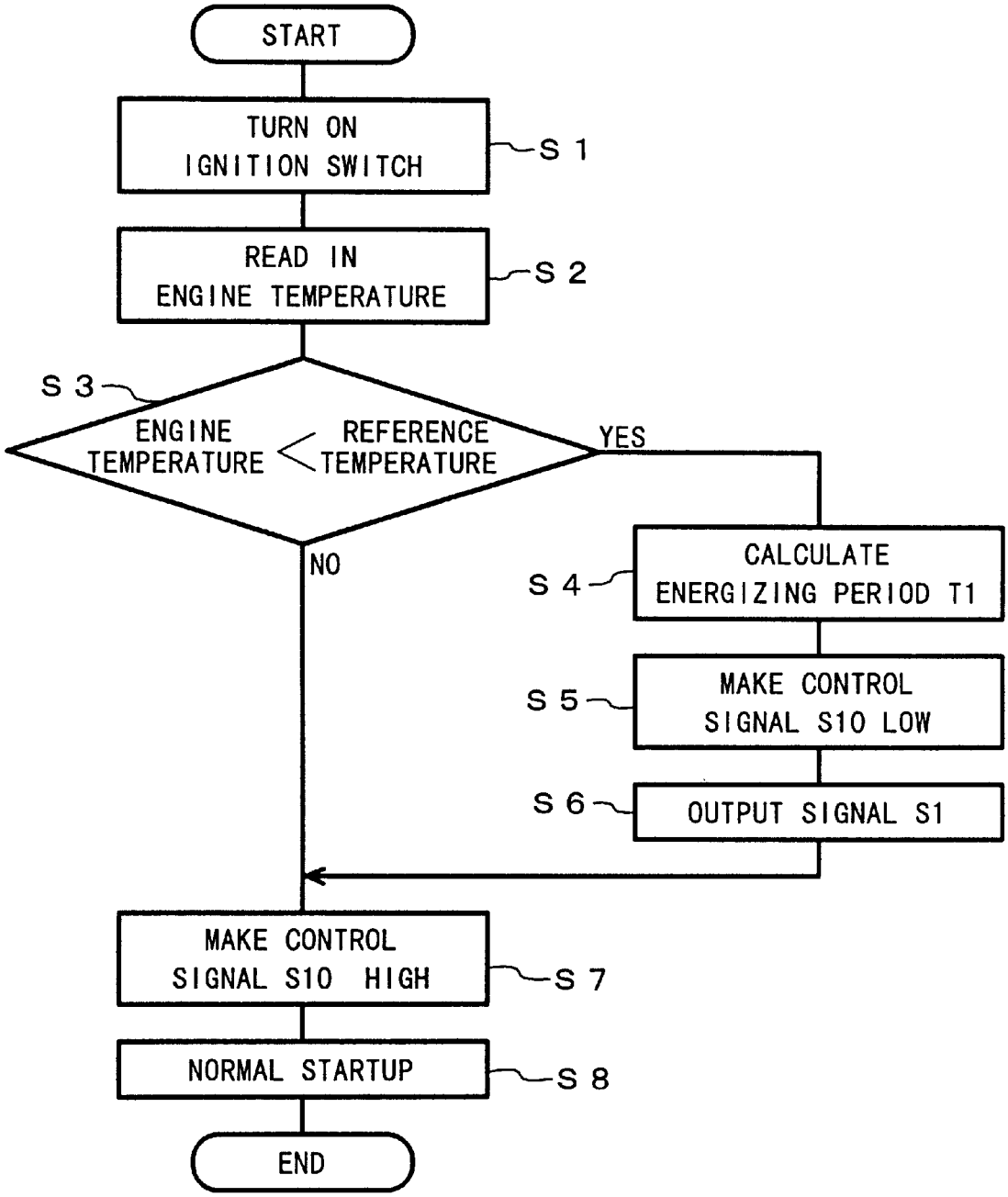
FIG. 6 is a flowchart showing the starting up of an engine.
Figure 9:
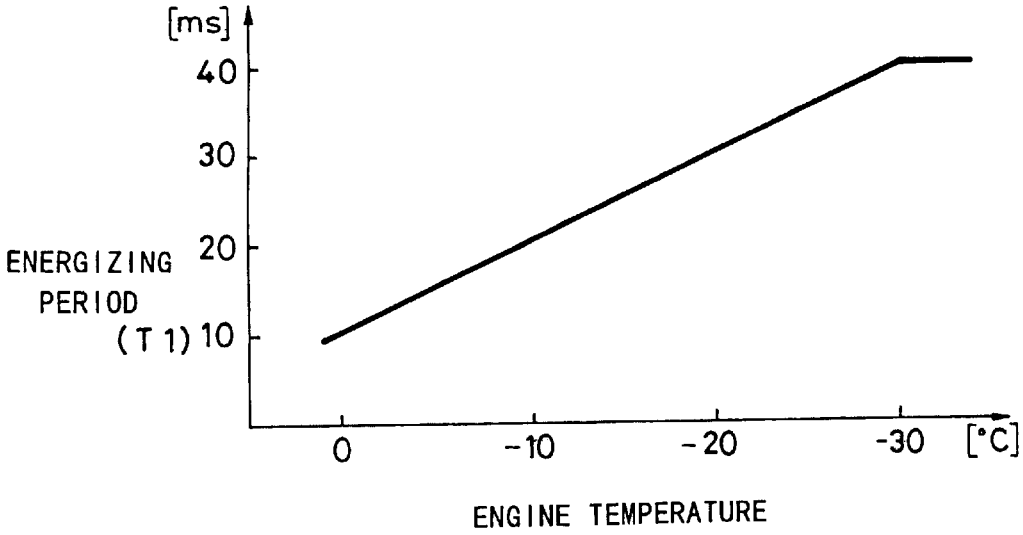
FIG. 9 is a graphic diagram showing the relationship between energizing period and engine temperature.

The switching of the startup mode is now explained referring to the flowchart of FIG. 6. The procedure starts with turning on the ignition switch 14 at Step S1 and fetching a temperature signal measured by the intake air temperature sensor TS1 and/or the cooling water temperature sensor TS2, indicative of the engine temperature, at Step S2. It is then examined at Step S3 whether or not the measured temperature is lower than a reference temperature (e.g. 0 C) where freezing of water is anticipated. When yes, the procedure goes to Step S4 where the energizing period T1 (a pulse width of the signal S1) is calculated by an energizing period setting means referring to the measured temperature. If the energizing period T1 is too short, the coil current may be shut off before the cling up is unfastened. If T1 is too long on the contrary, the thermal load to the injection valve and/or the switching element may be excessively increased. It is hence necessary to determine a proper length of the energizing period T1 corresponding to the measured temperature. The calculation may be performed using a predetermined function of temperature and time parameters or the table such as shown in FIG. 9, containing a predetermined relation between temperature and time. At Step S5, the control signal S10 is turned to low or "0". More specifically, after the lifting amount of the needle valve has been finished and the stabilizing period T2 has elapsed, the second operation mode is directly selected to close the valve without giving the hold period.

At Step S6, the signal S1 having a pulse width compatible with the energizing period T1 calculated at Step S4 is released. This actuates a valve amount to unfasten the cling up. At Step S7, the control signal S10 is turned to high or "1". More particularly, after the lifting amount is finished and the stabilizing period T2 is elapsed, the operation is switched to the first operation mode with the hold period. At Step S8, the normal startup is carried out in the first operation mode. When it is judged negative at Step S3, the procedure skips over Steps S4 to S6 and advances to Step S7.

The procedure shown in FIG. 6 permits the first operation mode to be applied to only the first valve opening signal after turning on of the ignition switch. Accordingly, even if the cling up is not eliminated in the first cycle of the valve opening amount, the first operation mode is applied to the second and more later valve opening signals. For ensuring the unfastening of the cling up, an extra step for confirming detection of the full opening of the valve or the decrease of the coil current (not shown) may be provided between Steps S6 and S7 in the flowchart of FIG. 6. When the decrease is confirmed, the procedure moves to Step S7. If not, the procedure returns back to Step S3.

FIG. 9 shows the relation between the energizing period and the engine temperature. As apparent, the lower the engine temperature, the (proportionally) longer the energizing period T1 is preferably timed. It should be noted that the energizing period T1 in this embodiment is constant when the temperature is lower than a particular level (e.g. −30 C).

The full opening of the fuel injection valve is detected by the decrease of the coil current after it increased in the embodiment, whereby the detection will hardly be affected by any change in the source voltage. The present invention is however not limited to the detection in the embodiment but may employ any other detecting method such as a stroke end detecting method disclosed in Japanese Patent Laid-open Publication No. SHO 58-211538. Although the cooling water temperature or intaken air temperature is used for selecting the operation mode in the low temperature startup and determining the energizing period T1 in the embodiments, any other signal indicative of the thermal condition of an engine, e.g. an output of an outside air temperature sensor, may be used with equal success.

The present invention allows the cling up of a fuel injection valve for injecting a jet of gaseous fuel into an engine, which is anticipated when the temperature is extremely low, to be easily unfastened in the first one or few cycles of fuel injection in the startup operation, thus improving the startup performance of the engine. In particular, the valve opening pulse signal for unfastening the cling up is provided without the hold period, hence permitting a minimum duration of fuel injection to be used for unfastening the cling up. The full opening of the valve or the unfastening of the cling up can be recognized by detecting the decrease of the coil current. The lower the engine temperature, the longer energizing period is provided thus ensuring the unfastening of the cling up.

What is claimed is:

1. A fuel injection valve controller apparatus for driving a fuel injection valve for a gaseous fuel internal combustion engine which is opened by feeding an electromagnetic coil with a current, comprising:

temperature detecting means for detecting the temperature representative of an engine temperature;

valve opening signal generating means for producing a valve opening signal which defines a period for opening the fuel injection valve;

driver controlling means adapted to be operable in one of a first operation mode having a hold period for holding the full opening of the fuel injection valve and a second operation mode not having the hold period and the driver controlling means being arranged in the first operation mode for decreasing the coil current after the fuel injection valve has fully been opened with a high intensity of the coil current fed to the electromagnetic coil in response to the valve opening signal and during the valve opening signal is enabled and switching means for, when the detected engine temperature is lower than a predetermined temperature, switching the driver controlling means to the second operation mode for at least first cycle of the valve opening operation after turning on of an ignition switch for starting up the engine, wherein the coil current in the second operation mode is shut off when it is detected that the fuel injection valve has fully been opened in response to the valve opening signal, regardless of the valve opening signal being enabled continuously.

2. A fuel injection valve controlling apparatus according to claim 1, further comprising:

current detecting means for generating a coil current signal indicative of the magnitude of the coil current flowing through the electromagnetic coil; and current change detecting means for detecting on the basis of the coil current signal that the coil current begins decreasing after increasing in response to the valve opening signal in order to recognize the full opening of the fuel injection valve.

3. A fuel injection valve controlling apparatus according to claim 2, wherein the current change detecting means comprises an operational amplifier having a positive input terminal which receives the coil current signal, a negative input terminal and an output terminal, a delay circuit connected between the output terminal and the negative input terminal of the operational amplifier, and a comparator for comparing an output of the operational amplifier with a predetermined reference setting and, when the output of the operational amplifier exceeds the reference setting, producing a signal indicative of a current change, the delay circuit having a small charge time constant enough to respond to an increase of the output from the output terminal and a large discharge time constant enough not to follow a decrease of the output.

4. A fuel injection valve controlling apparatus according to claim 3, further comprising a potential generating means connected between the output terminal of the operational amplifier and the input terminal of the delay circuit.

5. A fuel injection valve controlling apparatus according to claim 2, further comprising a current change emphasizing means for emphasizing a change in the coil current signal and wherein the current change detecting means receives the coil current of which change has been emphasized and detects the full opening of the fuel injection valve.

6. A fuel injection valve controlling apparatus according to claim 5, wherein the current change emphasizing means comprises a second operational amplifier having a positive input terminal which receives a coil current signal, a negative input terminal and an output terminal, a delay circuit connected between the output terminal and the negative input terminal of the second operational amplifier, and a filter means connected between the output terminal of the second operational amplifier and the input terminal of the operational amplifier in the current change detecting means.

7. A fuel injection valve controlling apparatus according to claim 1, wherein the period of enabling the valve opening signal in the second operation mode is a function of one of the engine temperature and a signal representative of the engine temperature and is set longer when the engine temperature is lower.

8. A fuel injection valve controlling apparatus according to claim 7, wherein the period of enabling the valve opening signal in the first operation mode is set equal to the period of enabling the valve opening signal in the second operation mode.

* * * * *